US005599090A

United States Patent [19]

Waldmann

[11] Patent Number: 5,599,090

[45] Date of Patent: Feb. 4, 1997

[54] LAMP WITH PROTECTIVE TUBE

[75] Inventor: Herbert Waldmann, Bad Dürrheim, Germany

[73] Assignee: Herbert Waldmann GmbH & Co., Villingen-Schwenningen, Germany

[21] Appl. No.: 413,510

[22] Filed: Mar. 30, 1995

[30] Foreign Application Priority Data

Apr. 20, 1994 [DE] Germany ..... 9406569 U

[51] Int. Cl.[6] ..... F21V 31/02

[52] U.S. Cl. ..... 362/267; 362/222; 362/424; 362/376

[58] Field of Search ..... 362/217, 223, 362/267, 221, 222, 376, 285, 422, 424

[56] References Cited

U.S. PATENT DOCUMENTS

| | | | |
|---|---|---|---|
| 3,331,958 | 7/1967 | Adler | 362/217 |
| 4,088,882 | 5/1978 | Lewis | 362/217 |
| 4,268,894 | 5/1981 | Bartunek et al. | 362/217 |
| 4,580,200 | 4/1986 | Hess et al. | 362/260 |
| 5,301,093 | 4/1994 | Baggio | 362/260 |

FOREIGN PATENT DOCUMENTS

| | | | |
|---|---|---|---|
| 103803 | 4/1990 | Japan | 362/267 |

*Primary Examiner*—Ira S. Lazarus
*Assistant Examiner*—Sara Sachie Raab
*Attorney, Agent, or Firm*—Eugene E. Renz, Jr.

[57] ABSTRACT

Lamp with protective tube comprising a transparent lamp tube, a bulb installed therein, and multi-part cap members tightly sealing off the lamp tube at both ends. The lamp is characterized in that both cap members (20, 20') have inner and outer compression rings (22, 22'; 23, 23') with facing thrust cones (22*c*, 23*c*), between which a sealing ring (24, 24') of rubber elastic material is clamped, the inner and outer compression rings (22, 22'; 23, 23') and the sealing ring (24, 24') being located inside the lamp tube (10). The outer compression ring (22, 22') being part of an actuating ring (22*a*, 22*a'*) located outside the lamp tube (10). The inner compression ring (23, 23') is moveable toward the outer compression ring (22, 22') by means of an adjusting ring (21, 21'), also located outside the lamp tube (10), and a tensioning mechanism (21*d*, 23*d*), actuateable by the adjusting ring.

12 Claims, 8 Drawing Sheets

LAMP WITH PROTECTIVE TUBE

BACKGROUND OF THE INVENTION

Lamps of this type are known, for example, from West German Model Registrations No. 90-00,959 and No. 90-13,783. They consist essentially of a transparent housing or lamp tube, into which a bulb, such as a florescent bulb, is inserted possibly with a reflector and an anti-glare grid. The lamp tube is sealed tightly at both ends with caps. The problem with these lamps is the difficulty of replacing the bulb.

A design which simplifies bulb replacement has already been proposed in West German Utility Model Registration No. 90-13,783. This design offers the advantage that the cap can be sealed with a knob that turns by hand.

SUMMARY OF THE INVENTION

The present invention is based on the task of making this lamp even easier to install and operate and of ensuring that the assembly remains water-tight even after the bulb has been replaced and both caps have been removed and reinserted.

This rusk is accomplished in accordance with novel features of construction and arrangement of the present invention. For example, it is a characteristic of the invention that both caps, which are essentially identical, have compression and sealing rings situated inside the lamp tube, which can be actuated manually by means of adjusting or actuating rings located outside the lamp tube. The diameters of these adjusting and actuating rings can be matched to the diameter of the lamp tube, as a result of which a compact and easy-to-manage unit is obtained, which does not easily become dirty.

These properties and the reliability with which the caps can be handled are improved by additional features, including the provision of a center boss on the inner compression ring passing through the outer compression ring and a tensioning mechanism consisting of a curved cam surface on the center boss which rises in the axial direction and on which the cam catches on the a adjusting ring slide and rests in a non-positive manner. Further, the inner and outer compression rings are provided with lugs and receptacles corresponding to the carrier lugs wherein the carrier lugs can be pushed into the receptacles in the axial direction, but engage in a power transmitting manner in the circumferential direction. Further, stop blocks associated with the cam catches are provided to limit the amount of rotation in one direction and stops cooperating with each other are provided on the adjusting ring and the actuating ring to limit the amount of rotation in the opposite direction.

In accordance with other features of the present invention, it is possible to rotate the bulb situated inside the lamp by means of the loosened cap so that the bulb can be positioned as desired around the axis of the lamp tube. To this end, a support rail carrying the bulb and its holders is provided which is rotatable with respect to the lamp tube and is adjustable in the axial direction, whereby carriers or lugs are provided on the inside surface of the inner compression rings to hold one end of the support rail. In a preferred embodi nent of this feature, a centering edge is provided on the inside surface of one of the compression rings which one end of the support rail is rotatably supported.

In accordance with still another feature of the present invention, the outer compression ring, which can be adjusted by means of an actuating ring, can be connected in a rotation-proof manner to the inner compression ring, so that the bulb located inside the lamp tube can be adjusted by moving the actuating ring outside the lamp tube.

To make it even easier to service the lamp with protective tube according to the invention without the need for tools, according to a further feature of the present invention, a plug coupling located inside the lamp tube is provided between the feed wires to the bulb and the teed cable which passes through the cap.

In accordance with still another feature of the present invention, a very simple means of mounting the lamp tube consists of a tension strap assembly, which, because of the freedom with which the tension bands can be moved axially and rotated with respect to the lamp tube, makes it possible to mount the lamp tube in nearly any conceivable position.

In the case of lamps which draw large amounts of power, it is frequently necessary, because of the large amount of heat which is generated and the large amount of space which is occupied, to install the ballast in a separate housing. An especially economical and advantageous method of producing this housing is to use extruded sections. In this case, grooves for mounting purposes can be provided on the housing when the material is extruded.

BRIEF DESCRIPTION OF THE DRAWINGS

These and other objects of the present invention and the various features and details of the operation and construction thereof are hereinafter more fully set forth with reference to the accompanying drawings, wherein.

DETAILED DESCRIPTION OF THE PREFERRED EMBODIMENT

Figure 1:
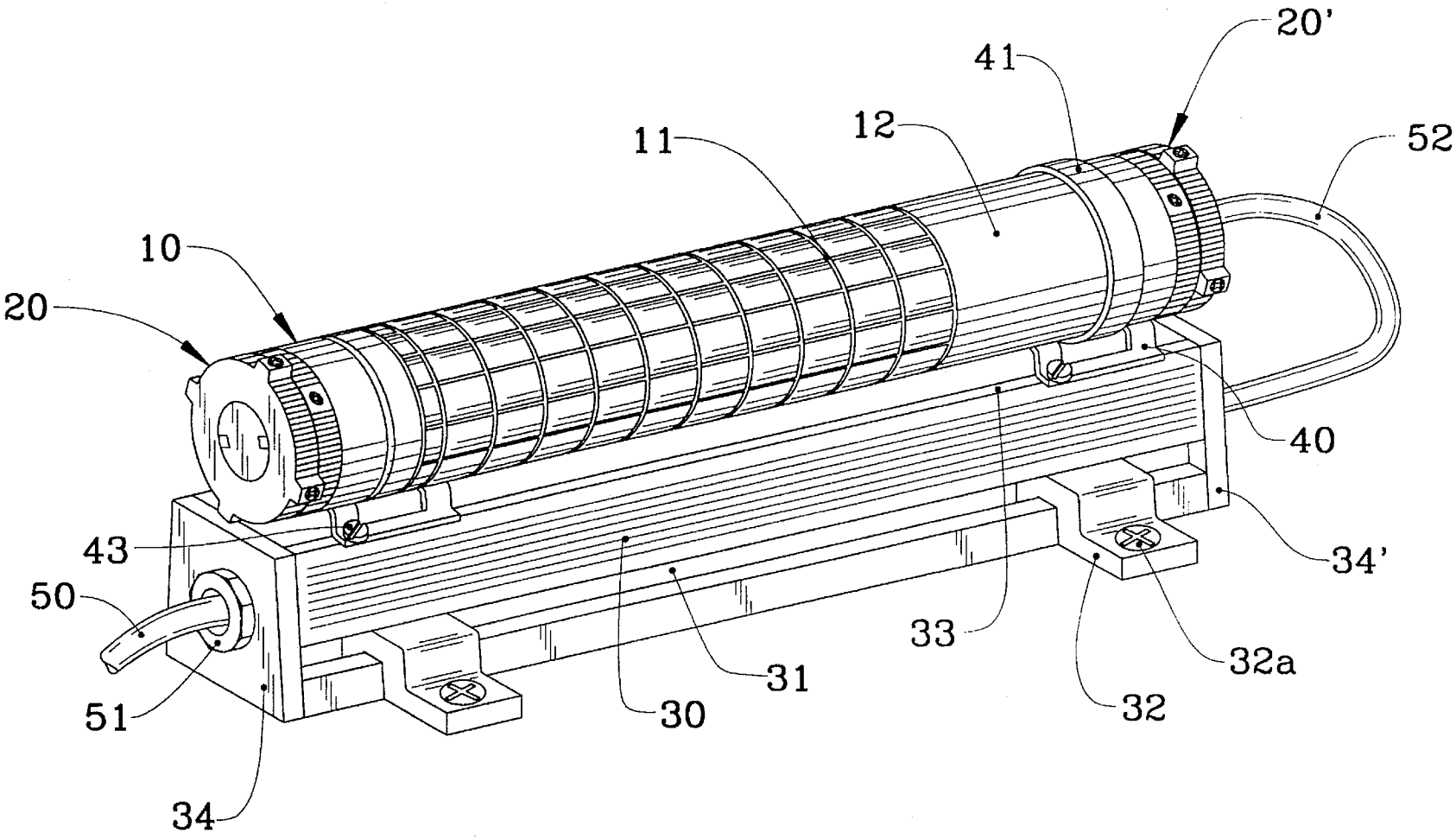
FIG. 1 is a perspective view of a lamp according to the invention.

Referring now to the drawings and particularly FIG. 1 thereof, there is shown a lamp assembly in accordance with the present invention. The lamp assembly consists of a lamp tube 10, which is attached to a housing 30, holding the ballast, by means of mounting brackets 40, tension straps 41, and fastening screws 43. Lamp tube 10 is sealed in a moisture-proof manner at both ends by means of multi-part closure caps 20, 20'. Inside lamp tube 10, there is a bulb, not visible in FIG. 1, behind an anti-glare grid 11, which is preferably designed as a parabolic grid. The right bulb holder and other electrical components are covered by a screen 12. Power is supplied through a cable 50, which is introduced into housing 30 and which is sealed off with respect to the housing by means of a screw joint 51. The bulb installed inside lamp tube 10 is connected electrically by feed cable 52 to the ballast. which is housed in housing 30.

Brackets 32, which serve to fasten housing 30 to a base (not shown), are provided with right-angle bends and through-holes 32*a*. The bent ends fit into and can slide along mounting grooves 31 on both sides of housing 30. As a result, the housing 30 can be mounted in many different ways to adapt to different types of mounting situations.

In the case of bulbs which draw large amounts of power, it is advisable to install the ballast in a separate housing because of the large amount of heat which the ballast develops. Housing 30, like lamp tube 10, can be made water-tight.

Figure 2:
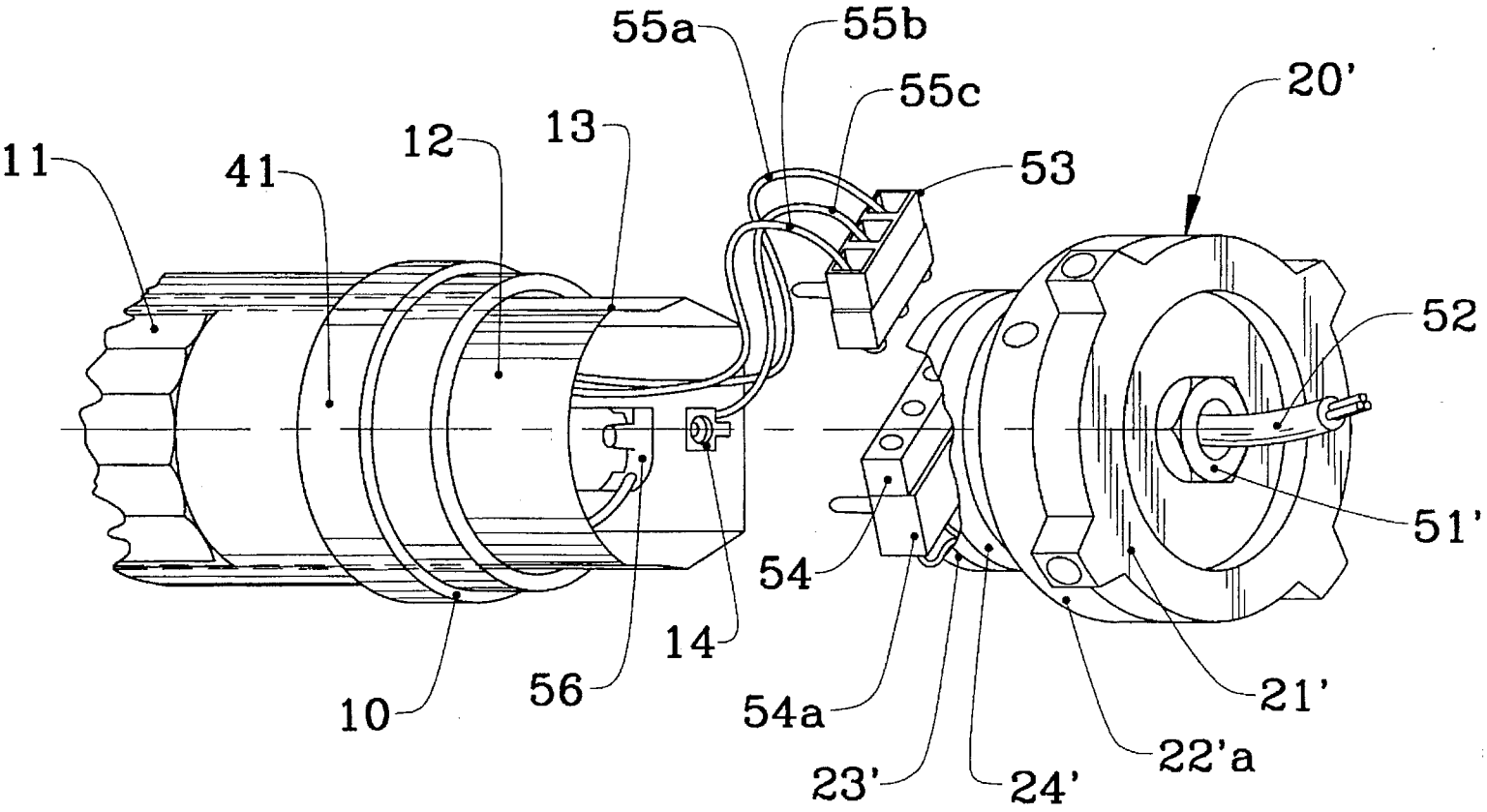
FIG. 2 is a partial exploded, perspective view of the lamp tube with the cap removed.

The simple method for replacing the bulb made possible by the design according to the invention is illustrated with particular clarity in the diagram of FIG. 2.

So that the bulb can be replaced, cap 20' must be removed first. For this purpose, it is necessary merely to rotate adjusting ring 21', and actuating ring 22'*a* toward each other. The adjusting ring 21' and actuating ring 21'*a* are knurled to facilitate rotation of these elements in the manner described. The cap design explained on the basis of FIGS. 5–8 means that, through this simple act of rotation, to be carried out by hand, sealing ring 24' is released, with the result that cap 20' can be pulled out of lamp tube 10. The electrical connection between cable 52 and electrical lead wires 55*a, b, c* is produced by means of a manually detachable coupling, which consists of a plug part 53 and a coupling part 54 with connecting terminals 54*a*. After cap 20' has been removed and coupling 53, 54 has been separated, the internal fittings located in lamp tube 10, consisting of a support rail 13 and the bulb parts explained fi rther below attached to it, can be pulled out.

Figure 3:
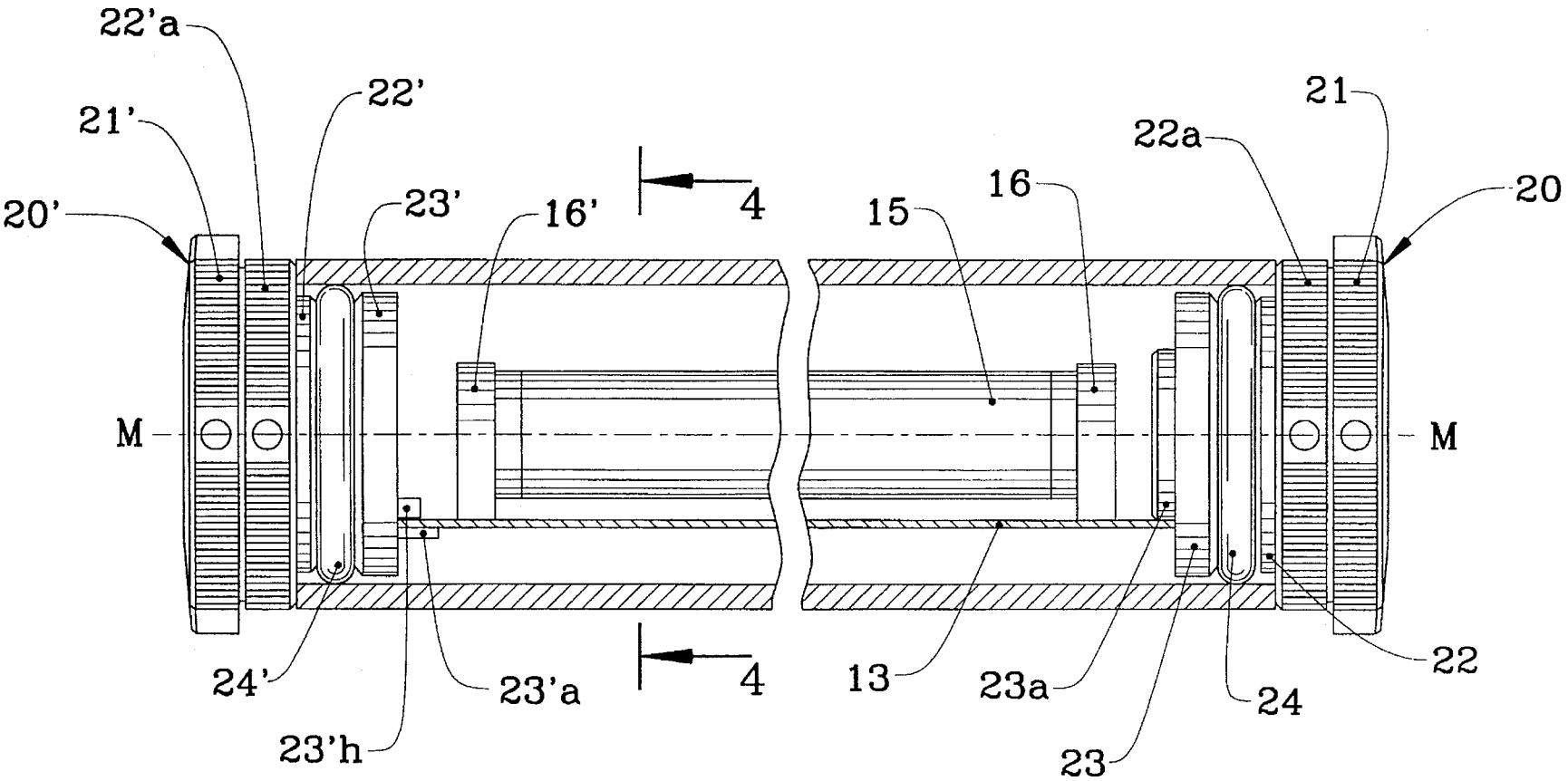
FIG. 3 is a side view of the lamp tube in partial cross section, part of its length being omitted.

In FIG. 3, the anti-glare grid has been omitted to improve the clarity of the illustration. Thus it can be seen how the bulb, in this case a florescent bulb 15, is supported at its ends by holders 16, 16' and mounted on support rail 13. The cross section of support rail 13 is approximately that of a trapezoid, the corner areas of which are supported on the inside surfaces of lamp tube 10, as can be seen quite clearly in FIG. 4. On the right in FIG. 3, support rail 13 is supported on a centering edge 23*a* of inner compression ring 22 with a non-positive type of connection, but is free to rotate in the circumferential direction.

Figure 4:
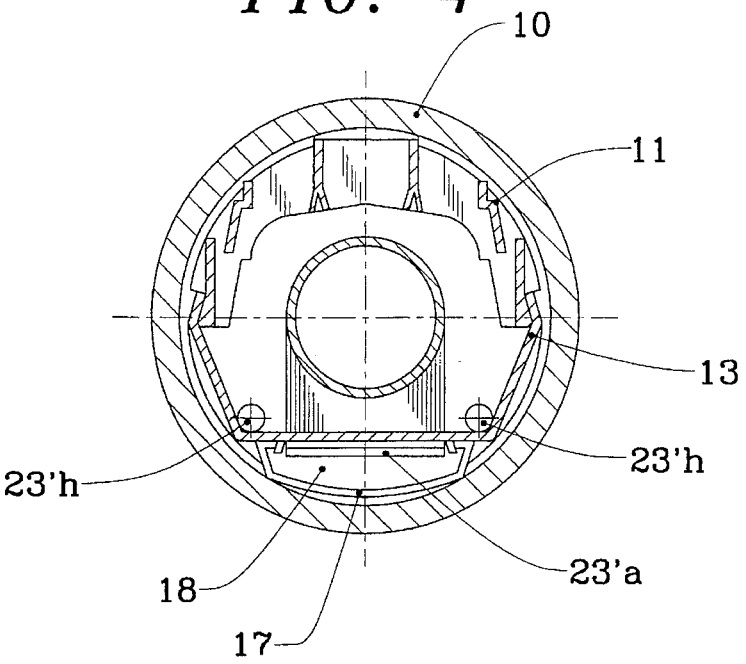
FIG. 4 is a radial cross section through the lamp tube along line IV—IV of FIG. 3.
Figure 5:
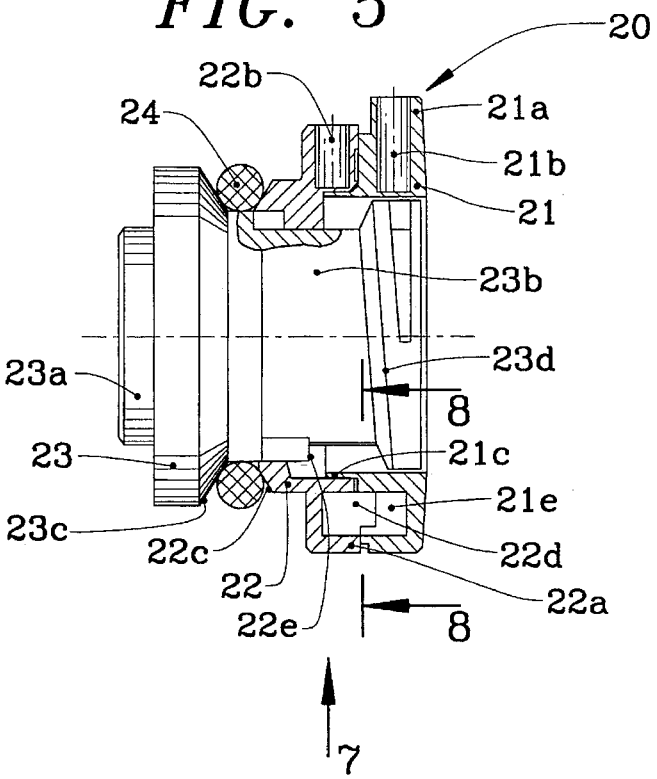
FIG. 5 is a partially cut-away side view of a multi-part cap.
Figure 6:
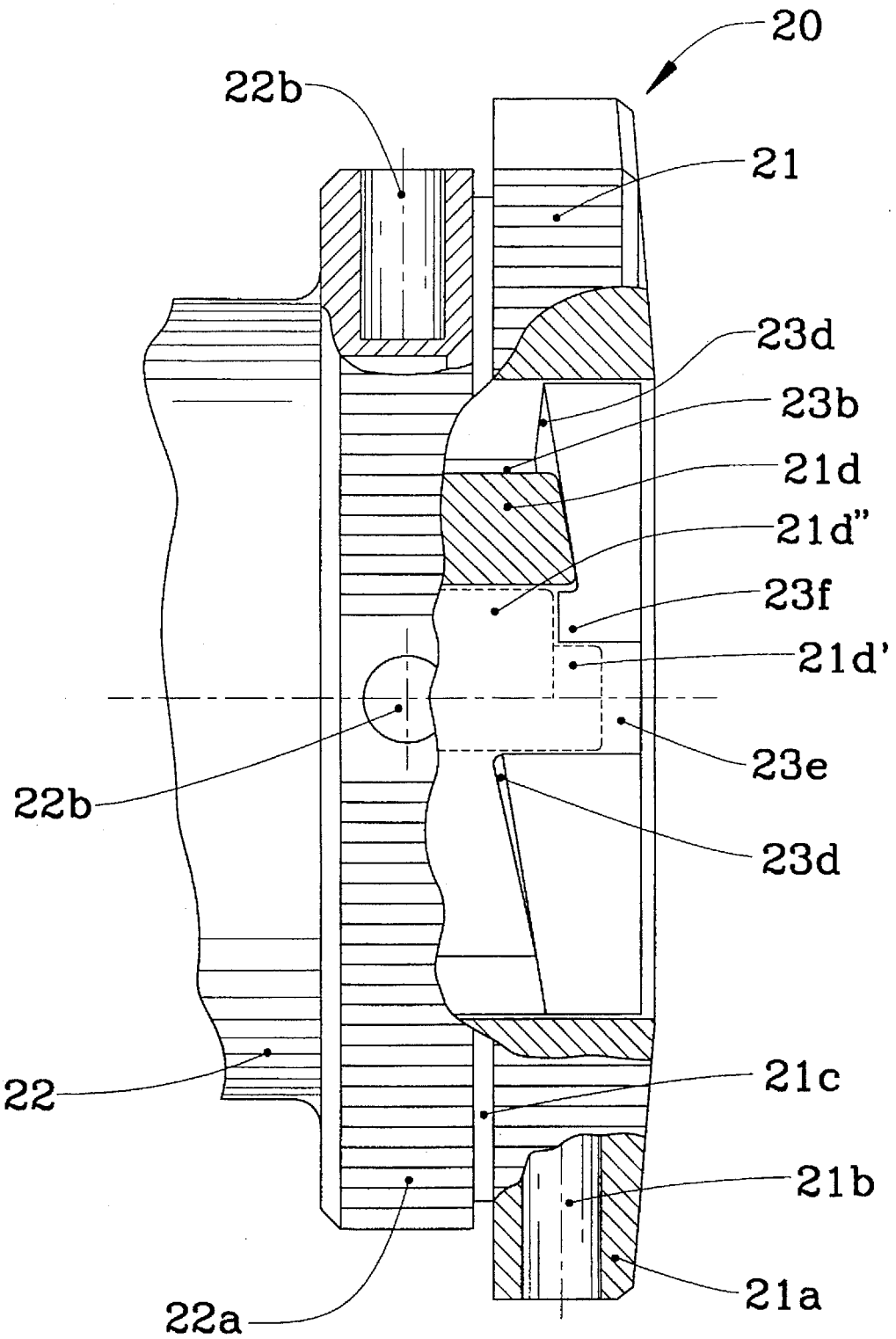
FIG. 6 is an enlarged partial view of the cap according to FIG. 5, partially cut away.
Figure 7:
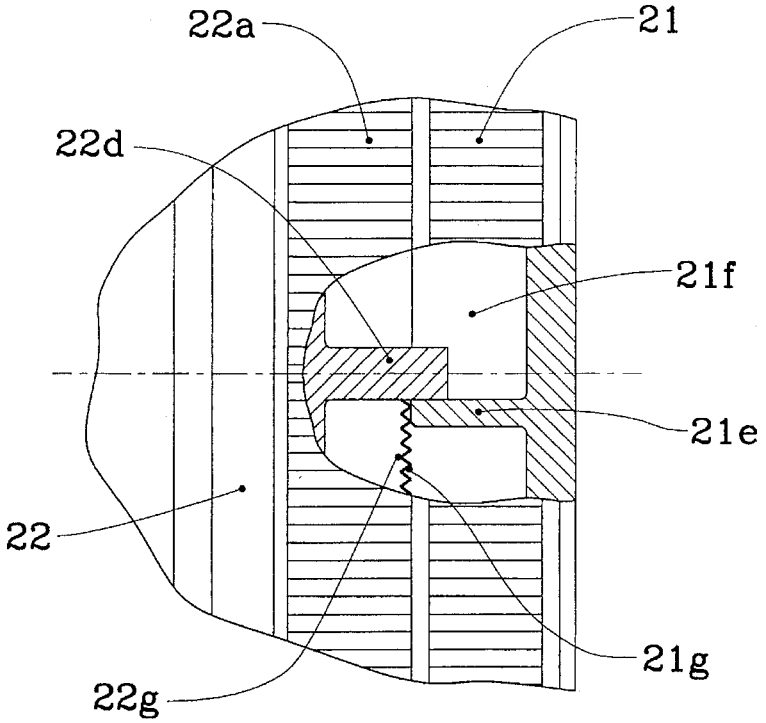
FIG. 7 is an enlarged view of the cap, partially cut away, as seen in direction VII according to FIG. 5.
Figure 8:
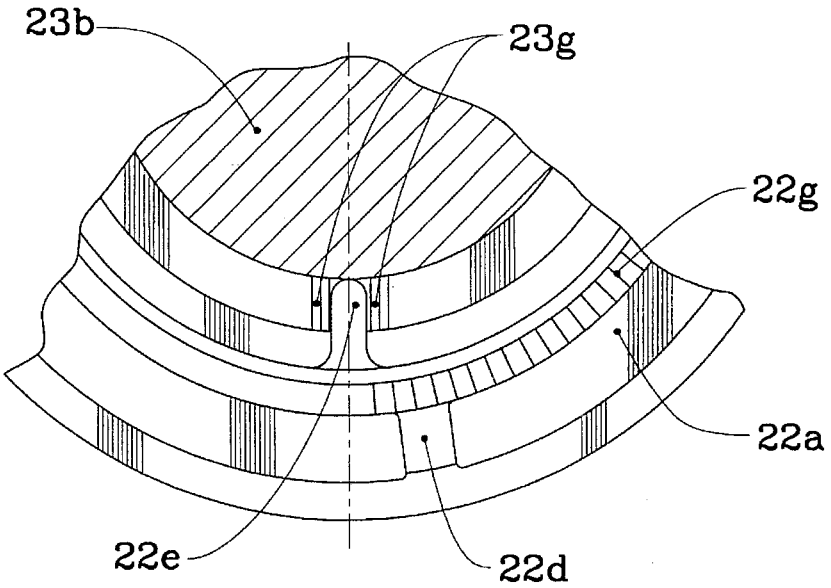
FIG. 8 is an enlarged, partial cross section of a view taken along lines VIII—VIII of FIG. 5, without outer compression ring 22.

On the left, sectioned rail 13 is held between a fin-like carrier 23'*a* and lugs 23'*h*, which are located underneath and above the base surface of support rail 13 as shown in FIG. 4 and are attached to the inside end surface of inner compression ring 23' (see FIG. 3). In this design, after adjusting ring 21' has been loosened by turning outer compression ring 22'*a*, support rail 13 can be rotated to position bulb 15 around center axis M-M. On the right side, section rail 13 is supported by centering edge 23*a* and also by the inside surface of lamp tube 10. The rotation-proof connection between outer actuating ring 22'*a* and inner compression ring 23', to which carrier 23'*a* and lugs 23'*h* are attached, is explained further below.

FIG. 4 also shows anti-glare grid 11, which is enclosed at its tree ends by the flank parts of support rail 13 and rests otherwise against the inside surface of lamp tube 10. A cover rail 17 is attached to the bottom surface of support rail 13. This cover rail 17, together with support rail 13, forms an insertion slot 18, in which carrier 23'*a* can engage.

The constructive design of the nearly identical multi-part caps 20, 20' is explained on the basis of cap 20, shown in all its details in FIGS. 5–8. Cap 20 differs from cap 20' only in that a centering edge 23*a* is provided on inner compression ring 23 of cap 20, whereas carrier 23'*a* and lugs 23'*h* explained above are provided on inner compression ring 23' of cap 20'.

Cap 20 is designed in such a way that it can be loosened without the use of a tool such as a screwdriver or wrench, i.e. merely by manually turning adjusting ring 21 with respect to actuating ring 22*a*. To improve the grip, the other peripheral surfaces of rings 21, 22*a* are knurled. To improve the transmission of forces even more, adjusting ring 21 has radially projecting grip knobs, spaced 90° apart. These grip knobs 21*a* are also provided with blind holes 21*b*, into which a tool can be inserted to increase the leverage, should rings 21, 22 ever become frozen as a result of corrosion or aging after prolonged use.

The non-positive connection between cap 20 and the lamp tube (not shown in FIG. 5) is produced by a sealing ring 24, which is mounted between outer and inner compression rings 22, 23. Outer and inner compression rings 22, 23 have slanted thrust cones 22*c*, 23*c* on facing sides, so that, when compression rings 23, 23 are tightened toward each other, sealing ring 24, which is resting against the inside surface of the lamp tube, is squeezed radially outward.

To allow this sequence of events, the cap parts are designed as follows:

Center boss 23*b* of inner compression ring 23 engages in the central opening of adjusting ring 21. In this area, center boss 23*b* has two opposing curved cam surfaces 23*d*, spaced 180° apart. Two cam catches 21*d*, also diametrically opposed, of adjusting ring 21 rest on these cams 23*d*; the cam catches form a sliding, non-positive connection, as can be seen especially clearly in FIG. 6. When adjusting ring 21, to which cam catches 21*d* are rigidly connected, is rotated with respect to center boss 23*b*, which carries cams 23*d*, inner compression ring 23, which forms a single unit with center boss 23*b*, is pushed in the axial direction.

To limit the rotational movement, cams 23*d* are equipped with axially inwardly projecting stop blocks 23*f*.

The elasticity of the material, specifically of sealing ring 24, makes it possible during the installation of adjusting ring 21 to push the ring inward until cam catches 21*d*, which are inserted into the axial openings 23*e*, as indicated by broken lines 21*d'*, 21*d''*, are able to pass over stop blocks 23*f*.

Outer compression ring 22, situated between adjusting ring 21 and inner compression ring 23, can move axially with respect to inner compression ring 23, but remains connected to it in a non-positive manner in the rotational direction. This rotation-proof connection is necessary so that the relative rotation between adjusting ring 21 and inner compression ring 23 can be produced manually to clamp sealing ring 24 in position. For this purpose, outer compression ring 22 has radially inward-pointing, diametrically opposing carrier lugs 22*e* (see especially FIG. 8), which engage in correspondingly shaped fork-like receptacles 23*g* in inner compression ring 23 to form a non-positive connection in the rotational direction while allowing movement in the axial direction.

As already mentioned, stop blocks 23*f* serve to limit the rotation of adjusting ring 21 with respect to inner compression ring 23 in one direction. To avoid excessive stress on the cap by overtightening in the other direction, a stop is also necessary for this direction. Anti-rotation stops 21*e*, which terminate ring-shaped grooves 21*f*, are provided on adjusting ring 21 to serve this purpose; stop blocks 22*d* projecting axially from outer compression ring 22 engage in the grooves, as the detailed diagrams according to FIG. 7 and FIG. 5 make clear.

To improve the locking of adjusting ring 21 in position with respect to outer compression ring 22, facing surfaces of these two rings can be equipped with mutually engaging, toothed latching surfaces 21*g*, 22*g*.

Figure 9:
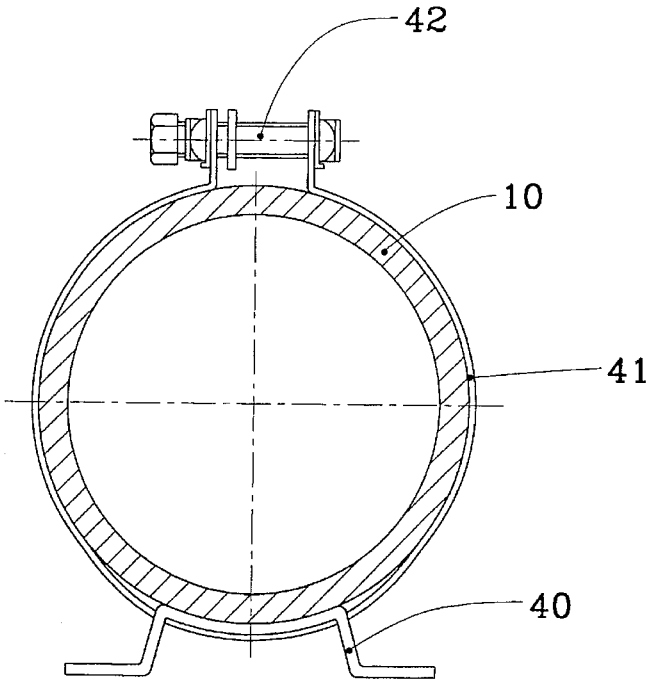
FIG. 9 is a radial cross section through the lamp tube with the mounting elements.
Figure 11:
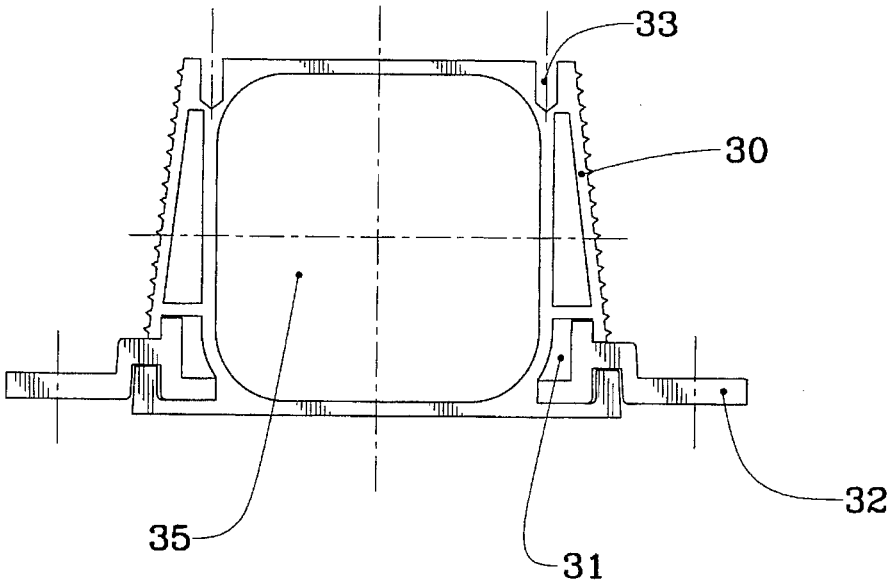
FIG. 11 is an end view of the housing according to FIG. 11 with cap 34 removed, without any of the internal and external fittings.
Figure 10:
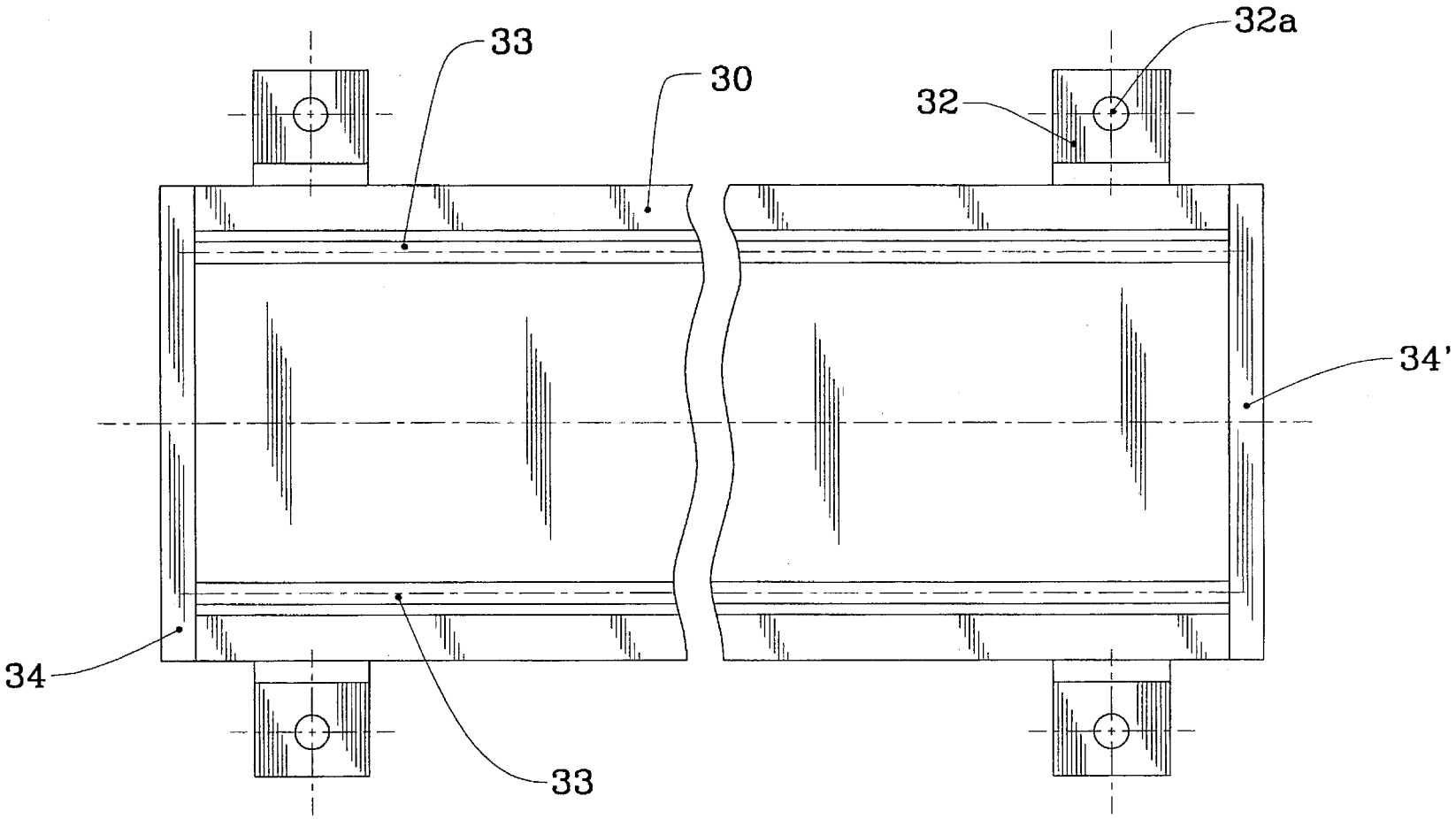
FIG. 10 is a view of housing 30 on an enlarged scale, part of its length being omitted.

FIGS. 9–11 illustrate the universal mounting feature of the lamp according to the invention. As FIG. 9 shows, lamp tube 10 is held in place in a very simple manner by a tension strap 41, which passes through a mounting bracket 40 and which can be tightened by a captive tightening screw 42. After tightening screw 42 has been loosened, the lamp tube can be rotated into any position around its axis and moved axially with respect to mounting bracket 40. Thus the lamp can be adapted to different mounting conditions.

By means of the same mounting brackets 40, lamp tube 10 can also be mounted on housing 30, shown in more detail in FIGS. 10 and 11. On the top, this housing has grooves 33, running lengthwise, into which self-threading screws can be screwed at any desired point for the attachment of mounting brackets 40.

The production costs of a housing such as this are extremely low when it is produced of hollow, extruded metal sections, which would be the logical choice for large production runs. In this case, the housing will consist of a partial length cut from the hollow section. Chamber 35 inside the section is closed off by end parts 34, 34' attached to both ends. A housing of this type can be made water-tight by inserting seals between side parts 34, 34' and housing 30.

Even though particular embodiments of the present invention have been illustrated and described herein, it is not intended to limit the invention, and changes and modifications may be made therein within the scope of the following claims.

What is claimed is:

1. A lamp with a protective tube comprising a transparent lamp tube, a bulb installed therein, and multi-part cap members tightly sealing off the lamp tube at both ends, characterized in that both cap members (20,20') have inner and outer compression rings (22, 22';23,23') with facing thrush cones (22*c*,23*c*), between which a sealing ring (24, 24') of rubber elastic material is clamped, said inner and outer compression rings (22,22';23,23') and said sealing ring (24,24') being located inside the lamp tube (10); said outer compression ring (22,22') being part of an actuating ring (22*a*,22*a'*) located outside the lamp tube (10), said inner compression ring (23,23') moveable toward said outer compression ring (22,22') by means of an adjusting ring (21,21'), also located outside the lamp tube (10), and a tensioning mechanism (21*d*, 23*d*), actuateable by said adjusting ring.

2. A lamp with a protective tube according to claim 1, wherein said inner compression ring (23) has a center boss (23*b*) passing through said outer compression ring (22) which engages in the central opening of the adjusting ring; and wherein said tensioning mechanism consists of two opposing curved cam surfaces (23*d*) on the center boss (23*b*), and two cam catches (21*d*) on the adjusting ring (21) to form a sliding connection.

3. A lamp with a protective tube according to claim 1, wherein said outer compression ring (22) has carrier lugs (22*e*), and said inner compression ring (23) has receptacles corresponding to the carrier lugs (22*e*), said carrier lugs (22*e*) displaceable pushed into said receptacles (23*g*) in the axial direction and engaging in a non-positive manner in the circumferential direction.

4. A lamp with a protective tube according to claim 2, including stop blocks (22*d*) assigned to the cam catches (21*d*) on the curved cam surfaces (23*d*) to limit rotation in one direction and stops (21*e*, 22*d*) cooperation with each other on the adjusting ring (21) and the actuating ring (22*a*) to limit the mount of rotation in the other direction.

5. A lamp with a protective tube according to claim 1 including an electrical feed cable passing through one of said cap members and wherein a plug coupling (54) is provided on inside surface of the inner compression ring (23'), to which the feed cable (52) is connected by way of a connecting terminal (54*a*) and into which a plug (53) can be removeably inserted, to which feed wires (55*a*,*b*) to the bulb (15) and a ground wire (55*c*) are connected.

6. A lamp with a protective tube according to claim 1 including a support rail carrying the bulb, said support rail being rotatable with respect to the lamp tube and adjustable in an axial direction (M-M) also, and wherein carriers (23'*a*) lugs (23'*h*) are provided on an inside end surface of one of the two inner compression rings (23') to hold one end of the support rail (13).

7. A lamp with a protective tube according to claim 6, characterized in that, on the inside surface of the other inner compression ring (23), a centering edge (23*a*) is provided, on which the other end of the support rail (13) is rotatably supported.

8. A lamp with a protective tube according to claim 1, including tensioning straps (41) which surround the lamp tube (10) and which pass through a mounting bracket (40) with freedom to rotate into any position around an axis of said lamp tube and to move axially with respect to said mounting bracket.

9. A lamp with a protective tube according to claim 8, characterized in that the lamp tube (10) is attached to a housing (30), which holds a ballast.

10. A lamp with a protective tube according to claim 9, characterized in that the housing (30) consists of a hollow, extruded section, to both ends of which end parts (34,34') are attached, in a water-tight manner.

11. A lamp with a protective tube according to claim 10, characterized in that, the housing (30) has mounting grooves (31 ), into which moveable mounting brackets (32) are inserted.

12. A lamp with a protective tube according to claim 9, characterized in that the lamp tube (10) is attached to the housing (30) by mounting brackets fastened by means of screws in parallel grooves (33) provided on an outside wall, preferably on the cover part, of the housing (30).

* * * * *